United States Patent [19]

Walton et al.

[11] Patent Number: 4,921,643

[45] Date of Patent: May 1, 1990

[54] WEB PROCESSING WITH TWO MATED ROLLS

[75] Inventors: Richard R. Walton, Ten W. Hill Pl., Boston, Mass. 02114; George E. Munchbach, Roslindale, Mass.

[73] Assignee: Richard R. Walton, Boston, Mass.

[21] Appl. No.: 211,385

[22] Filed: Jun. 24, 1988

[51] Int. Cl.[5] ..... B31F 1/12

[52] U.S. Cl. ..... 264/282; 162/280; 264/286; 264/287; 425/336; 425/369; 425/374

[58] Field of Search ..... 26/18.6; 28/247, 263; 162/280, 281, 282; 264/168, 280, 282, 283, 285, 286, 287; 425/224, 328, 336, 369, 374, 396

[56] References Cited

U.S. PATENT DOCUMENTS

| | | | |
|---|---|---|---|
| 623,695 | 4/1899 | Arkell | 264/286 |
| 739,276 | 9/1903 | Allen | 425/303 |
| 1,295,636 | 2/1919 | Tong | 162/281 |
| 1,447,699 | 3/1923 | Wandel | 162/282 |
| 1,548,783 | 8/1925 | Lorenz | 162/113 |
| 1,548,788 | 8/1925 | Lorenz | 162/282 |
| 1,548,789 | 8/1925 | Lorenz | 162/282 |
| 1,550,084 | 8/1925 | Lorenz | 162/282 |
| 1,554,246 | 9/1925 | Wandel | 162/282 |
| 1,571,594 | 2/1926 | Lorenz | 425/336 |
| 1,582,839 | 4/1926 | Lorenz | 162/113 |
| 1,582,840 | 4/1926 | Lorenz | 162/282 |
| 1,582,841 | 4/1926 | Lorenz | 162/282 |
| 1,582,842 | 4/1926 | Lorenz | 162/282 |
| 1,582,843 | 4/1926 | Lorenz | 162/282 |
| 1,601,633 | 9/1926 | Lorenz | 162/280 |
| 1,627,966 | 5/1927 | Goodlett | 162/282 |
| 1,630,320 | 5/1927 | Wandel | 162/281 |
| 1,667,292 | 4/1928 | Lorenz | 162/280 |
| 1,676,655 | 7/1928 | Lorenz | 162/282 |
| 1,680,203 | 8/1982 | Cannard | 162/113 |
| 1,680,797 | 8/1928 | Lorenz | 162/280 |
| 1,686,388 | 10/1928 | Lorenz | 162/113 |
| 1,689,037 | 10/1928 | Lorenz | 162/280 |
| 1,690,172 | 11/1928 | Lorenz | 162/280 |
| 1,690,411 | 11/1928 | Hudson | 162/281 |
| 1,701,685 | 2/1929 | Lorenz | 162/280 |

(List continued on next page.)

FOREIGN PATENT DOCUMENTS

| | | |
|---|---|---|
| 0047397 | 8/1981 | European Pat. Off. . |
| 127110 | 1/1902 | Fed. Rep. of Germany . |
| 130463 | 5/1902 | Fed. Rep. of Germany . |
| 727763 | 6/1936 | Fed. Rep. of Germany . |
| 1018716 | 10/1957 | Fed. Rep. of Germany . |
| 1093659 | 11/1960 | Fed. Rep. of Germany . |
| 1816028 | 12/1968 | Fed. Rep. of Germany . |
| 1955196 | 11/1969 | Fed. Rep. of Germany . |
| 91122 | 7/1972 | German Democratic Rep. . |
| 8504369 | 10/1985 | PCT Int'l Appl. . |
| 752191 | 6/1953 | United Kingdom . |
| 1104972 | 3/1968 | United Kingdom . |

*Primary Examiner*—Jay H. Woo
*Assistant Examiner*—C. Scott Boshey
*Attorney, Agent, or Firm*—Fish & Richardson

[57] ABSTRACT

A machine and process for a web of material employing two side-by-side sets of spaced apart driven disks adapted to rotate respectively in opposite directions about two spaced apart parallel axes, the axes being sufficiently close that peripheral margins of the disks of one set run between the peripheral margins of the disks of the other set in a mated relationship, the sets of disks mutually defining a series of web driving regions spaced apart in a direction parallel with the axes, with successive web driving regions, offset from one another, open channels between said disks providing, with the driving regions, a width-wise continuous, non-linear cross-section corridor through which the web passes, the driving regions adapted to impart to a web led lengthwise into the corridor, crosswise tension in the web, pulling the web about the edges of the disks, the tension enabling the disks to apply forward driving force to the web and retarding means closely disposed to the driving regions located to apply retarding forces on the web in the region of the corridor, the retarding forces opposing the driving forces to produce immediate, continual longitudinal shortening of the web. The machine and process is especially useful in softening strong sheets as by permanently loosening bonds between components of the web.

16 Claims, 8 Drawing Sheets

U.S. PATENT DOCUMENTS

| | | | |
|---|---|---|---|
| 1,702,166 | 2/1929 | Lorenz | 162/281 |
| 1,751,471 | 3/1930 | Campbell | 162/280 |
| 1,764,676 | 6/1930 | Campbell | 162/281 |
| 2,196,006 | 4/1940 | Benedict | 156/201 |
| 2,224,713 | 12/1940 | Rowe et al. | 428/153 |
| 2,245,014 | 6/1941 | Sherman | 162/117 |
| 2,425,207 | 8/1947 | Rowe | 264/134 |
| 2,623,572 | 12/1952 | Haas | 425/214 |
| 2,793,418 | 5/1957 | Pfau | 28/265 |
| 2,814,332 | 11/1957 | Molla | 425/143 |
| 2,851,206 | 9/1958 | Guenther et al. | 223/28 |
| 2,915,109 | 12/1959 | Walton | 425/324.1 |
| 2,917,784 | 12/1959 | Spence et al. | 264/168 |
| 2,938,568 | 5/1960 | Cock | 264/286 |
| 2,958,608 | 11/1960 | Barnard | 428/141 |
| 3,022,545 | 2/1962 | Wylde et al. | 264/168 |
| 3,260,778 | 7/1966 | Walton | 264/282 |
| 3,353,222 | 11/1967 | Keel et al. | 28/263 |
| 3,383,449 | 5/1968 | Muller | 264/287 |
| 3,390,218 | 6/1968 | Painter et al. | 264/282 |
| 3,400,193 | 9/1968 | Lefevre et al. | 264/282 |
| 3,639,955 | 2/1972 | Fleissner et al. | 28/1.6 |
| 3,800,373 | 4/1974 | Fleissner | 28/1.6 |
| 3,806,406 | 4/1974 | Ely | 162/206 |
| 4,033,709 | 7/1977 | Kroyer | 425/224 |
| 4,090,385 | 5/1978 | Packard | 162/282 |
| 4,142,278 | 3/1979 | Walton et al. | 26/18.6 |
| 4,422,892 | 12/1983 | Plant | 156/209 |
| 4,432,927 | 2/1984 | van Tillburg et al. | 264/282 |

WEB PROCESSING WITH TWO MATED ROLLS

BACKGROUND OF THE INVENTION

This invention relates to a machine and method for processing webs in which the web is longitudinally compressed under the influence of driving forces provided by two rotating rolls and retarding forces applied by stationary members.

In some known machines used for corrugating paper, the two rolls are themselves corrugated and the roll corrugations are mated such that the paper, when passed through the nip, becomes corrugated.

Lorenz, U.S. Pat. No. 1,689,037, shows a pair of mated serrated rolls for corrugating paper, followed by a pair of guide bars defining a corrugated channel through which the paper passes on its way to a pair of creping rolls.

In Cannard, U.S. Pat. No. 1,680,203, a web is creped by passing it into the nip between two drive rolls each having disks alternating with spacer elements. The disks of one roll may be offset relative to the other roll. After passing through a relatively long confining passage, the web is engaged by slower rotating rolls which cause the web to crowd together in the long passage to form transverse crepes. The long passage is bounded by two sets of long, thin members, the forward ends of which are tapered and disposed in the spaces between the disks of the drive rolls.

Molla, U.S. Pat. No. 2,814,332, shows a paper-forming machine in which two serrated rolls with toothed lands impress a pattern on the web and a set of fingers interdigitated in the valleys of the lower roll strip the web off the lower roll.

SUMMARY OF THE INVENTION

The invention can be employed to impart highly desirable properties, especially permanent softness, to webs.

The invention features a machine and process that employs two side-by-side sets of spaced apart driven disks adapted to rotate respectively in opposite directions about two spaced apart parallel axes, the axes being sufficiently close that peripheral margins of the disks of one set run between the peripheral margins of the disks of the other set in a mated relationship, the sets of disks mutually defining a series of web driving regions spaced apart in a direction parallel with the axes, with successive driving regions off-set from one another and open channels between the disks providing, with the driving regions, a width-wise continuous non-linear cross section corridor through which the web passes, the driving regions adapted to impart to a web led lengthwise into the corridor, crosswise tension in the web, pulling the web about the edges of the disks, the tension enabling the disks to apply forward driving force to the web and retarding means closely disposed to the driving regions to apply retarding forces on the web in the region of the corridor, the retarding forces opposing the driving forces to produce immediate, continual longitudinal shortening of the web.

Preferred embodiments of the invention include the following features. Means following the retarding means applies tension in the machine direction to pull out compaction produced by the retarding means. Smaller diameter segments alternate with the disks along the axis of each roll. The disks are all of the same diameter. Each disk bears a non-friction driving surface.

The web is stretched width-wise as it passes through the corridor. Both rolls rotate at the same angular velocity. The web is a hard-surfaced material. The web has a high tensile strength in the directions of both its width and length. The web is building-wrap material formed of hot calendered, spun bonded fibers and the shortening produced is pulled out to create a softened or more pliable web. The retarding means has retarding fingers; each finger lies opposite one of the disks to apply a retarding force on one face of the web while an opposing driving force is applied by the disk to the opposite web face. The fingers present convexly curved surfaces to the faces of the web. The processed web is substantially softer than the unprocessed web with the softness not being lost by the action of plastic memory, even after a long period of time.

Other advantages and features will become apparent from the following description of the preferred embodiment, and from the claims.

DESCRIPTION OF THE PREFERRED EMBODIMENT

We first briefly describe the drawings.

DRAWINGS

Figure 2:
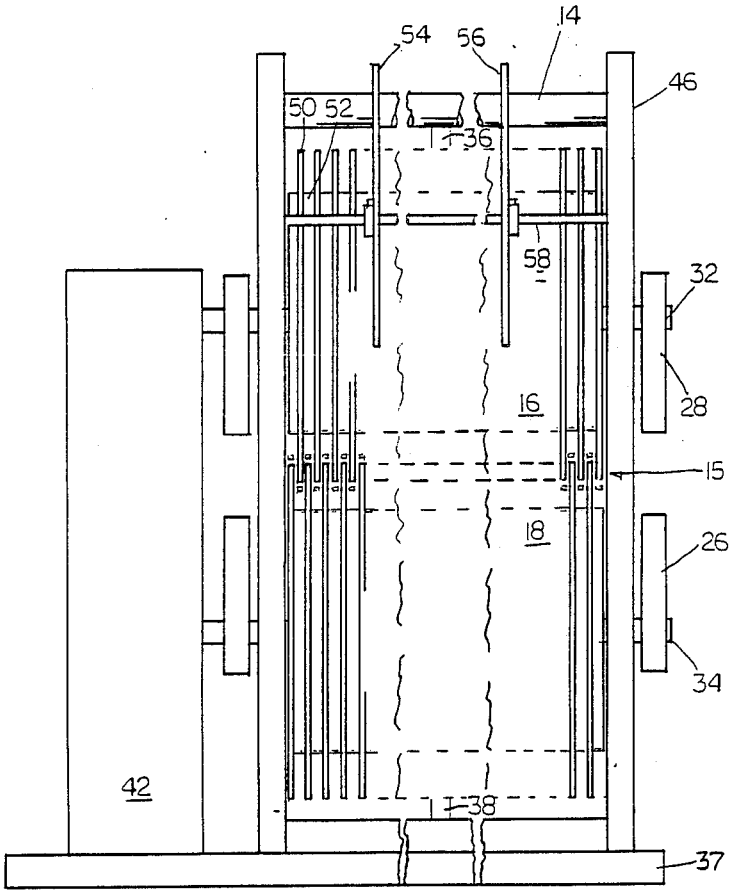
FIG. 2 is a view from the infeed side of the machine.
Figure 2B:
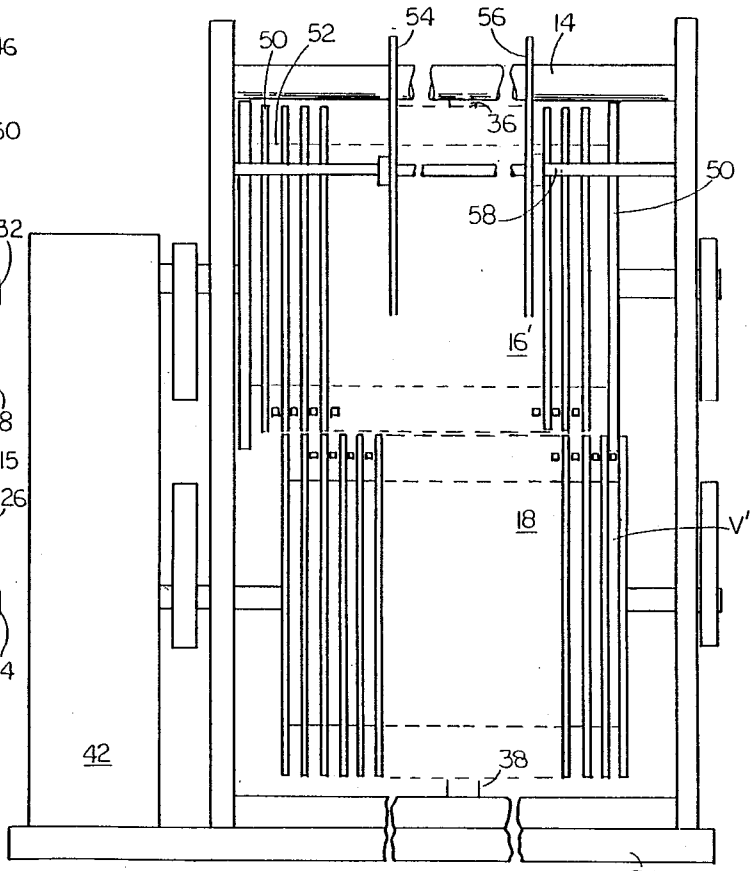
Figure 2A:
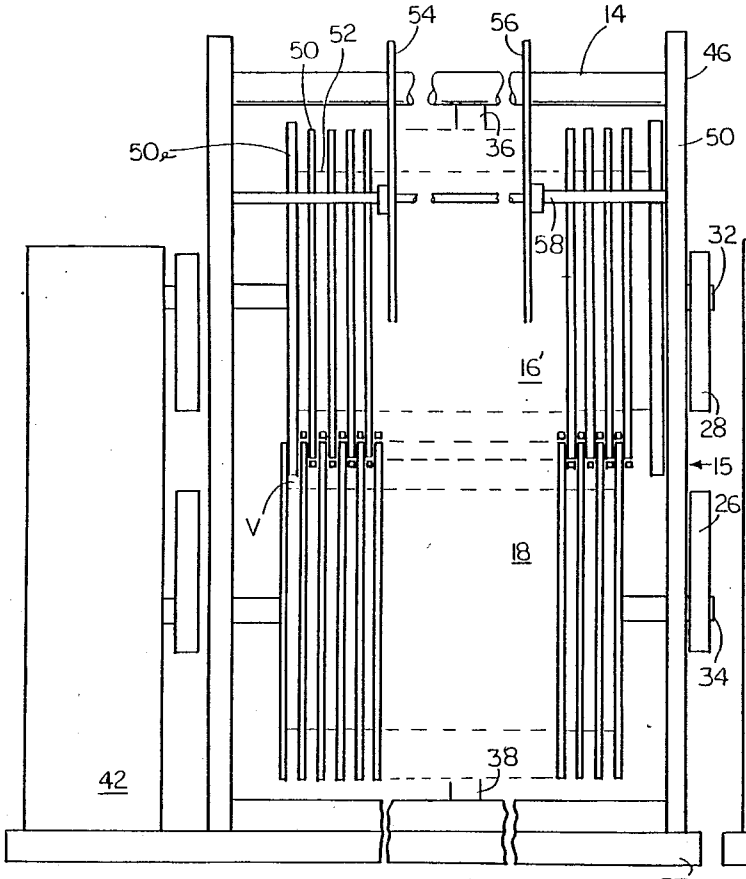

FIG. 2*a* and 2*b* are views similar to FIG. 2 of another embodiment of the invention, illustrating the use of the same machine components in the mated condition of the invention, FIG. 2*a*, or in the matched condition, 2*b*, adapted to operate in another way.

Figure 3:
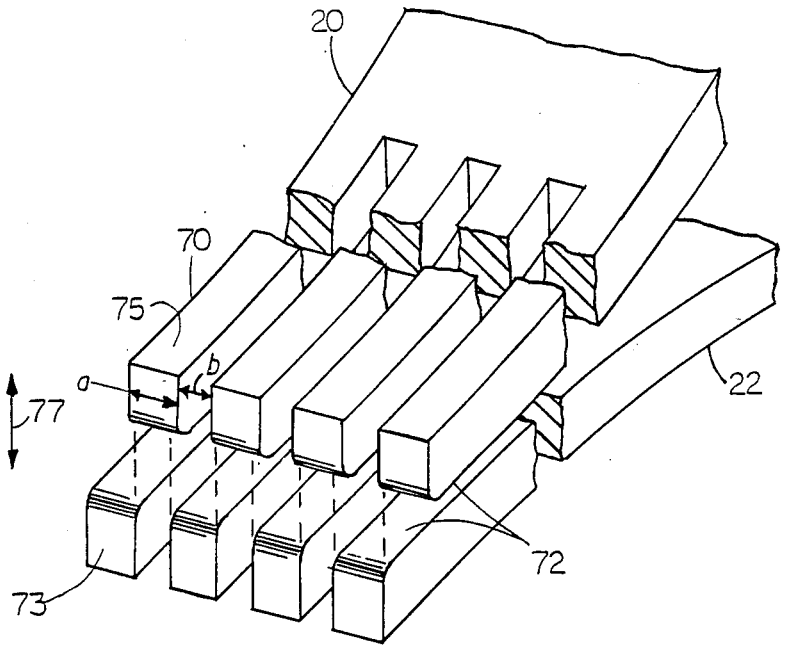

FIG. 3 is an isometric cutaway view of representative portions of retarders of the machine in one position of possible adjustment.

Figure 4:
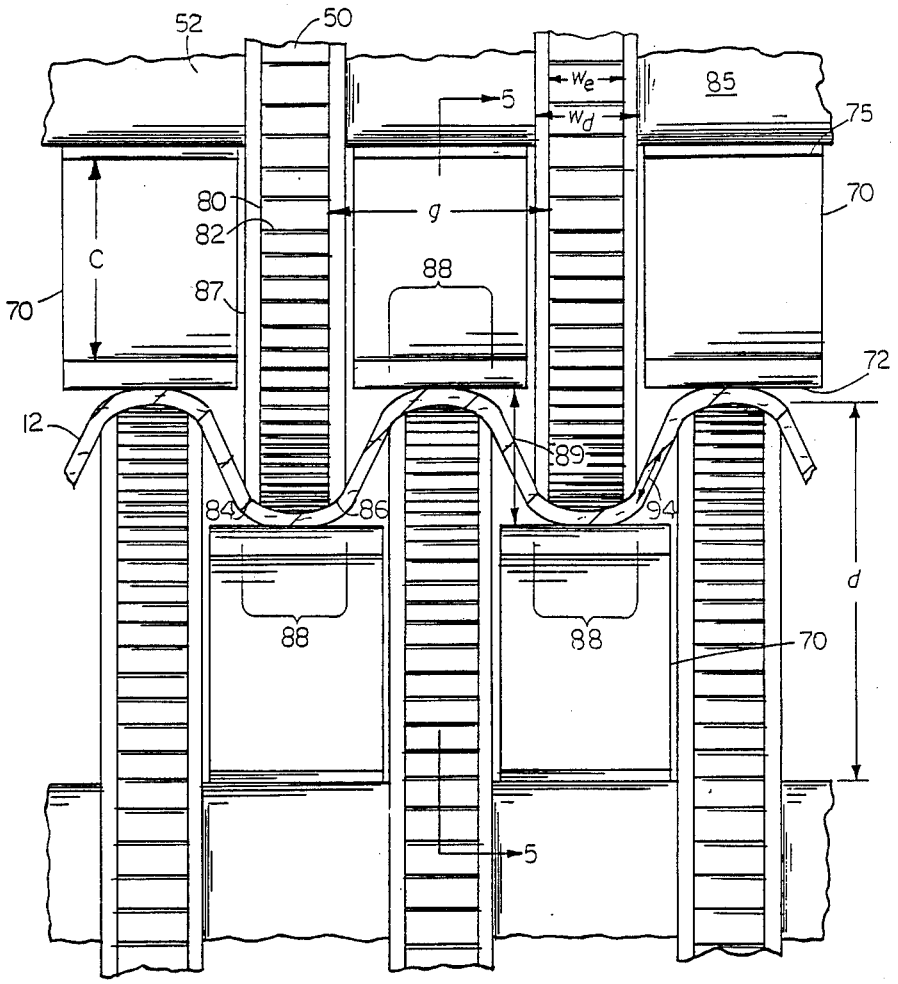
Figure 4A:
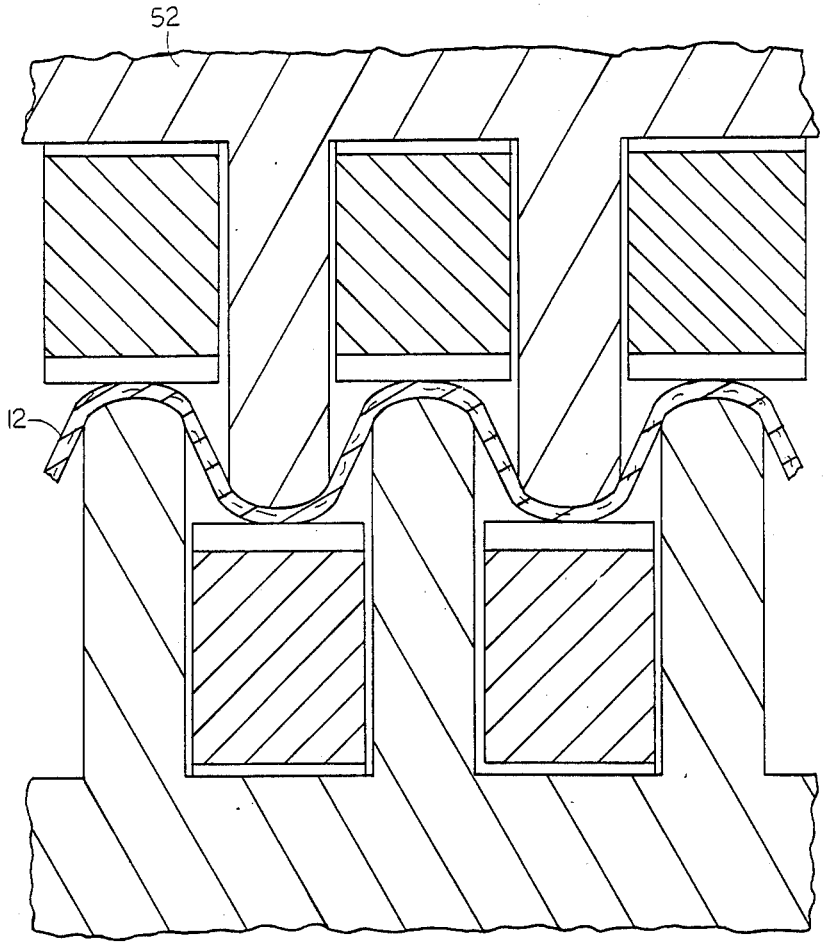
Figure 5:
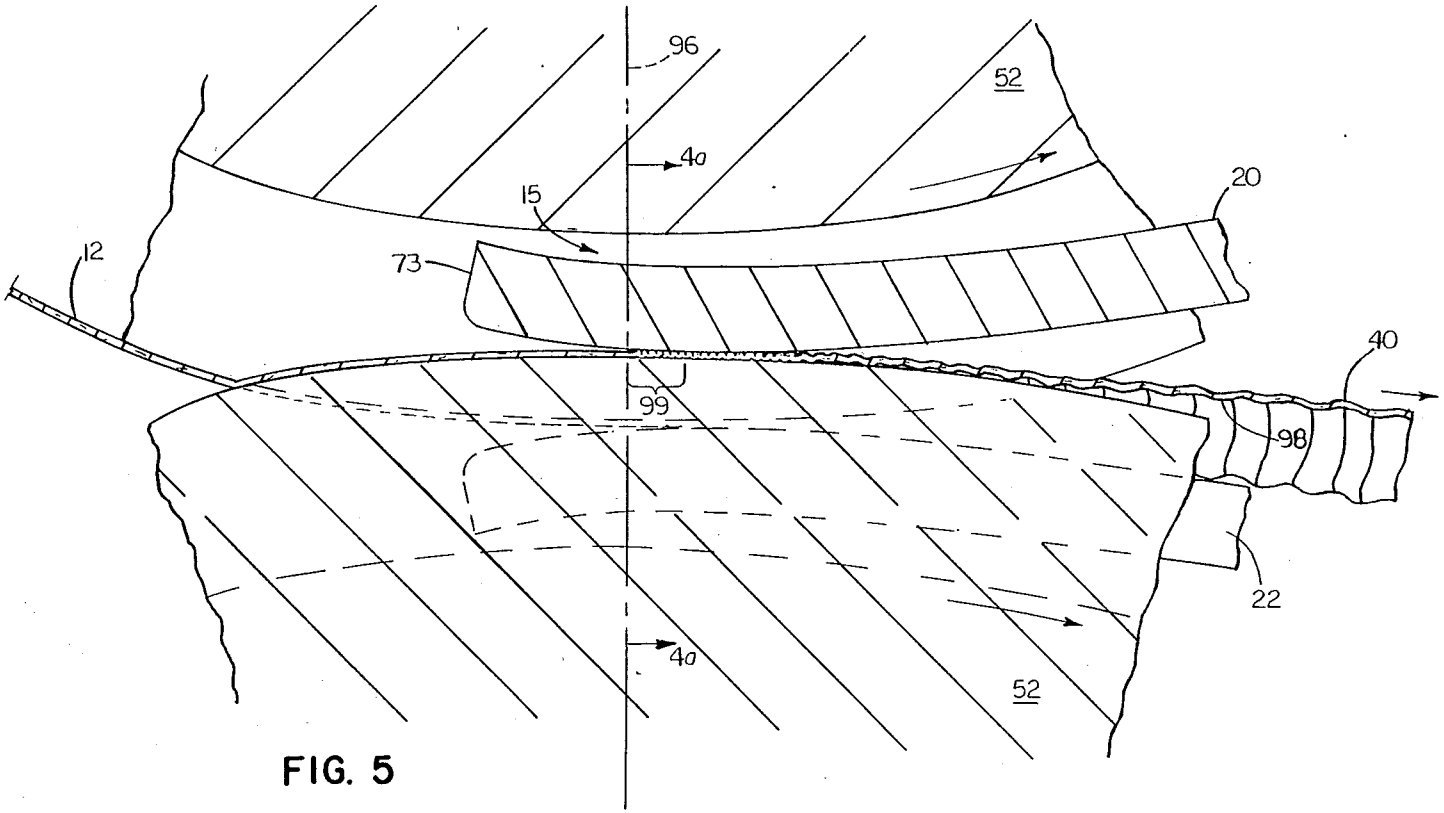

FIG. 4 is an enlarged view, not to scale, from the infeed side, of a representative portion of the corridor between the two drive rolls of the machine while FIG. 4*a* is a cross-section at 4*a*–4*a* in FIG. 5.

FIG. 5 is a side sectional view at 5—5 in FIG. 4.

Figure 6:
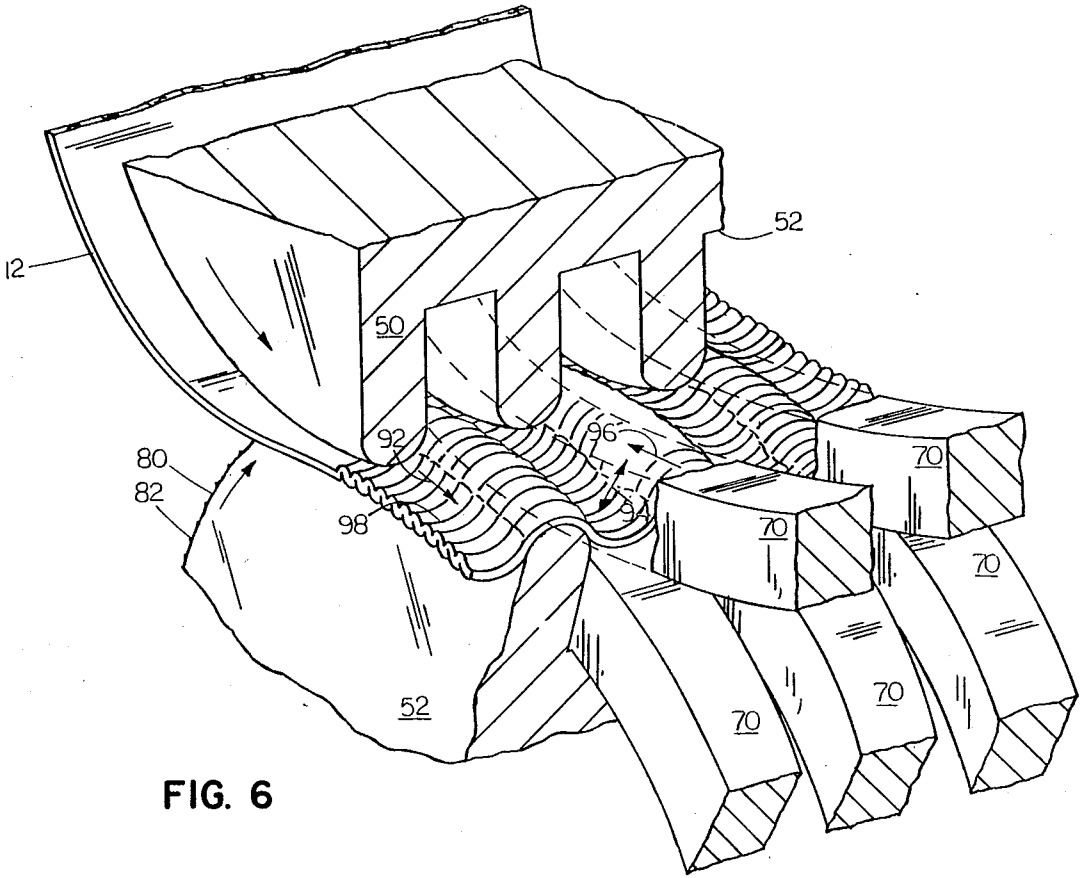

FIG. 6 is a diagrammatic isometric cutaway view of a representative portion of a web being processed in the machine.

STRUCTURE AND OPERATION

Figure 1:
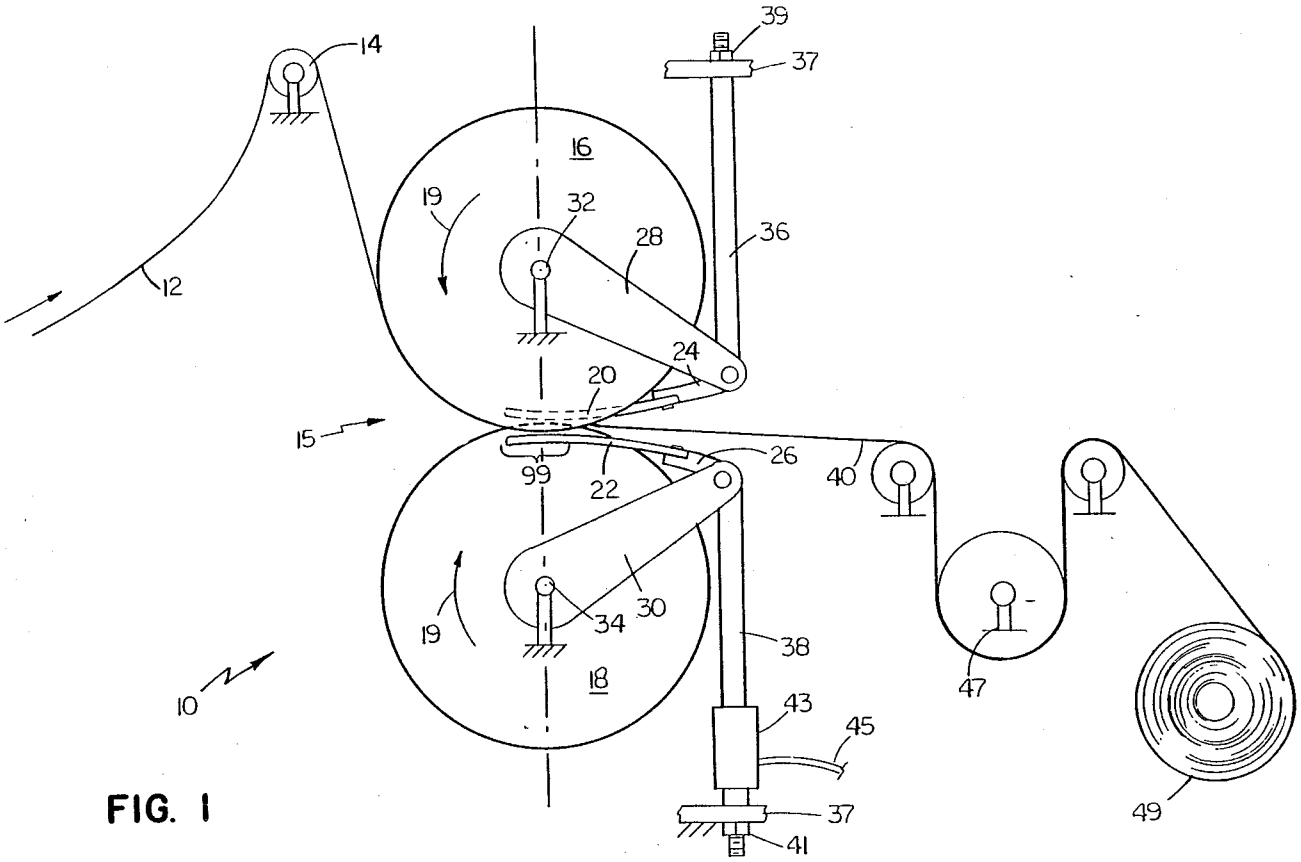
FIG. 1 is a side view of portions of a web processing machine.

Referring to FIG. 1, in web processing apparatus 10, a continuous dense web 12 is led from a supply roll (not shown) over a guide roll 14 into the meshed region 15 between two drive rolls 16. 18 that are driven at the same speed in opposite directions (as indicated by arrows 19). On the outfeed side, a pair of retarders 20, 22 are positioned to retard the motion of web 12 in a manner to be described below. After processing, the web 40 is tensioned by controlled dancer roll 47 and led to driven takeup roll 49.

Retarders 20, 22 are respectively held in brackets 24, 26 which are in turn mounted respectively on supports 28, 30. Each support 28, 30 is held in place at one end by being mounted rotatably on a shaft 32, 34 of one of the rolls 16, 18, and at the other end by a supporting rod 36, 38. Rods 36, 38 occupy fixed positions during a processing run but their lengths (and hence the precise positions of retarders 20, 22 relative to the nip region) can be adjusted by a conventional adjustment mechanism (not shown). The ends of rods 36, 38 are threaded and removably held to the frame 37 by nuts 39, 41. By removing the nuts, the rods can be released from the frame and the retarders pulled away from region 15 for servicing. Rod 38 holds a pneumatic cylinder 43 supplied by a pressure line 45, thus supporting rod 38 resiliently.

Referring to FIG. 2, rolls 16, 18 are driven at a selected speed by a conventional motor and driving mechanism 42 mounted on frame 37. Rolls 16, 18 are supported in a metal frame 46 (also mounted on frame 37) with the axes of the two rolls parallel. The vertical spacing between the two rolls can be adjusted by conventional means (not shown) but the spacing between them is generally held fixed during a processing run. Each roll 16, 18 is milled to form a set of identical, spaced apart larger diameter (4") disks 50 alternated with a set of identical segments 52 of somewhat smaller diameter (3 ⅝"). At meshed region 15, each roll 16, 18 thus presents a series of alternating lands (formed by the peripheral walls of the larger disks 50) and valleys (formed by the peripheral walls of the smaller segments 52). Rolls 16, 18 are axially offset relative to one another to enable these lands and valleys to be mated, that is with the lands of roll 16 nestled to a limited extent in the valleys of roll 18 and the valleys of roll 16 nestled in the lands of roll 18. Thus the peripheral margins of the disks 50 of roll 16 run between the peripheral margins of the disks 50 of roll 18.

In order to guide webs of different widths into the central part of meshed region 15, a pair of plates 54, 56 is adjustably mounted on a rod 58 attached to frame 46. The width of the opening between plates 54, 56 can then be adjusted to accommodate the width of web 12. Each plate 54, 56 is narrow enough to slip between adjacent disks 50 to position the web.

Rolls 16, 18 contain conventional electric heating elements (not shown) that can be controlled to bring the rolls to a desired even temperature appropriate for processing the particular web being used.

Referring to FIG. 2*a*, the machine of FIG. 2 is modified in having a pair of enlarged disks 50*e* and 50*e*', on roll 16', one of which, 50*e*, is shown nestled in an endmost valley V of the mating roll 18'. In this embodiment roll 16' is axially adjustable, as well as being movable away from roll 18'. The machine is readily set up for mated operation by adjusting roll 16' axially until enlarged disk 50*e* registers with valley V, and enters valley V upon adjustment of the rolls together. This assures registry of all the other disks with their valleys. (Referring to FIG. 2*b*, the other enlarged disk 50*e*', when it enters valley V', ensures that the disks are matched in direct opposition with respect to one another, to operate according to a different matched mode of treatment, in which pairs of disks form drive rings to drive the web and pairs of retarders match to form retarding cavities to retard the web.)

Referring to FIG. 3, each of the two retarders 20, 22 is cut from a sheet of 0.125" thick metal to form a row of parallel evenly spaced retarder fingers 70. Each finger 70 has a convexly curved contact surface 72 that contacts one face of the web and an end face 73 that is substantially perpendicular to the plane of the web. The width a of each finger 70 (e.g., 0.090") and the width b of the space between adjacent fingers 70 (e.g., 0.060") are such that successive fingers 70 nest within successive valleys along the corresponding roll 16, 18 with the lands of the roll positioned in the spaces b. The two retarders are offset laterally with respect to one another so that each finger on retarder 20 lies above an inter-finger space of retarder 22.

Each finger 70 also has a surface 75, parallel to surface 72, which, during operation, faces (but does not bear against) the peripheral surface (85 in FIG. 4) of the smaller diameter segment associated with that finger. Each retarder 20, 22 is attached to its associated bracket 24, 26 by conventional means. Each retarder 20, 22 is rolled to have a curvature of radius of about 4" along the length from retarding face 72 to the brackets 24, 26, with the two retarders curving away from each other towards their bracketed ends. Fingers 70, being of cantilever form, are resiliently deformable in the direction indicated by arrows 77 under the influence of operating conditions.

Referring to FIG. 4, each finger 70 has a thickness c (e.g., 0.125") that is considerably smaller than the depth d (e.g., ⅜") of the valley in which it nests. Each larger diameter disk 50 is machined to have a central peripheral driving track 80. The total width $w_d$ of disk 50 is, e.g., 0.050", the width $w_e$ of the track 80 is between 0.025" and slightly less than 0.050" (e.g., 0.045"), and the total space g between tracks is between 0.100" and 0.150" (e.g., 0.110"). Track 80 is cylindrical, its surface is parallel to the roll axes 32, 34 (FIG. 2), and it bears a high friction surface formed either by parallel knurling cuts 82 spaced at intervals of, e.g., 80 cuts per inch, or by plasma coating. On either side of track 80 is a smooth convex shoulder 84, 86 which is contoured to meet the side surface 87 of the larger diameter disk 50. Corresponding lands and valleys of the mated rolls 16, 18 thus form a series of driving regions 88, where the web 12 is driven toward the outfeed side. Successive driving regions lie at different distances from one of the roll axes 32, 34, i.e. they are offset with respect to each other in the direction transverse to the roll axes. A radially oriented open channel 89 joins each pair of adjacent driving regions, so that the driving regions and joining channels together form a corridor of non-linear cross section in the direction of the width of the web through which the web 12 extends. The retarders 20, 22 are positioned at the outfeed end to resist the motion of web 12. The convex surface of each finger 70 contacts the web for retarding. As adjusted as shown in FIG. 5 the fingers extend past the line of centers of the rolls, while contact with the web is made on the opposite face of the web from the face touching a land, at a position only slightly downstream of the position of maximum drive by the disk. In another condition of adjustment, forward extensions of the fingers may serve as stationary driving shoes, pressing the web into engagement with the disks, to enhance the forward drive of the web.

Referring to FIG. 5, the longitudinal compression of web 12 occurs in a short length region 99 beginning approximately at the line of centers of the two rolls (at plane 96, on which the roll shafts 32, 34 lie) and ending at a point a short distance (i.e., a distance far shorter than the radius of the rolls 16, 18) on the outfeed side.

The size of region 99 will depend on the thickness of the web being processed and on the fineness of the microcreping desired. A thicker web will require a greater distance and a shorter distance will produce a finer microcrepe. The best distance for a particular web and desired treatment is determined by trial of a number of different settings.

Prior to feeding the leading edge of the web into region 15, the spacing between the contact faces of opposing retarder teeth may have been temporarily reduced by the resilience of the fingers or their mounting. That spacing can be opened up to its normal running size either by a tool or simply by driving the web into region 15; in that case the web itself will force open the teeth. Also, when operation is first begun, the spacing between the roll axes must be adjusted (by nuts 39, 41, FIG. 1). In general, the correct adjustment is determined by increasing the spacing while feeding the web until the web is no longer longitudinally cut by the action of the driving rolls. Note that the width-wise corridor in which the web lies is not a traditional nip because each land is not opposed by a closely spaced corresponding land such that the web is pinched between and driven by them.

Referring to FIGS. 5, 6, in operation, web 12 is driven forward throuGh the corridor by the action of the rotatinG rolls. Each larger disk 50 drives the face of the web that it touches. The driving force 92 is attained by the high friction drive surfaces of the larger disks that engage the driving regions of the web in combination with width-wise tension 94 on the web which causes it to be held against the lands. The width-wise tension also causes a degree of width-wise stretching of the web.

On the non-driven face of each driven region of the web, the driving force 92 is opposed by a retarding force 96 imparted by a retarding tooth 70. Because the two sets of retarders 20, 22 are laterally offset relative to one another, a retarding tooth is located at every position along the width of the web; thus the driving action is opposed at all positions along the web but alternately on opposite faces of the web. The retarders cause the web to be longitudinally compacted in a series of microcrepes 98. The microcreping occurs within a short distance on the outfeed side of the driving locations.

When the untreated web is a hard material, e.g., Tyvek (available from DuPont), the combination of width-wise stretching and longitudinal compaction alters the web fibers in a way that produces a softer processed web. Furthermore, the plastic memory that is normally associated with certain web materials and causes them, over time, to return to their pre-processed condition, is effectively minimized, giving the processed web a long shelf life during which its softness does not diminish.

The process is particularly useful with webs that demonstrate considerable widthwise tensional strength and is particularly appropriate where it is desired to disrupt fiber-to-fiber bonds to render the web softer and more easily draped or wrapped about objects. The softening action arises through a triangulation of different forces. Advantageously the take up device 47 applies sufficient tension to pull out the microcrepe formations following the retarder means, to restore the web to substantially its original width, but in a softened condition.

Other embodiments are within the following claims.

For example, other configurations of retarders can be used. The rolls can be of different diameters and driven at different speeds. The valleys in one roll can be deeper than the valleys in the other roll. The retarder teeth can be provided with a high frictional contact surfaces. Widths of the lands and valleys can be altered. The teeth of the retarders could bear against the peripheral surfaces of the smaller diameter disks.

We claim:

1. A machine for processing a web of material comprising two side-by-side sets of spaced apart driven disks rotatable respectively in opposite directions about two spaced apart parallel axes, the axes being sufficiently close that peripheral margins of the disks of one set run between the peripheral margins of the disks of the other set in a mated relationship, the peripheries of the sets of disks mutually defining a series of web driving regions spaced apart in a direction parallel with said axes, with successive web driving regions offset from one another, open channels between said disks providing, with said driving regions, a width-wise continuous, non-linear cross-section corridor through which said web passes, said driving regions constructed and arranged to impart to a web led lengthwise into said corridor, crosswise tension in said web, pulling said web about the edges of said disks, said tension enabling said disks to apply forward driving force to said web, and retarding means in the form of two sets of retarding fingers, one set disposed on each side of the web with fingers interposed in the spaces between respective disks, whereby the fingers in one set are laterally offset with respect to fingers in the other set, said fingers being closely disposed to said driving regions, and located and constructed to apply retarding forces on said web in the region of said corridor over a short distance relative to the radius of said disks, said retarding forces opposing said driving forces to produce immediate, continual longitudinal shortening of said web.

2. The machine of claim 1 including means following said retarding means to apply tension in the machine direction to the treated web to substantially pull out lengthwise compaction produced by said retarding means.

3. The machine of claim 1 wherein smaller diameter segments alternate with said disks along the axis of each said set of disks.

4. The machine of claim 1 wherein said disks are all of the same diameter.

5. The machine of claim 1 wherein said disks bear a high friction driving surface.

6. The machine of claim 1 wherein the depth of penetration of one set of disks into the other is of the order of the spacing between adjacent disks to produce width-wise stretching of the web as it passes through said corridor.

7. The machine of claim 1 wherein drive means rotate said rolls at the same angular velocity.

8. The machine of claim 1 wherein each of said retarding fingers lies in an opposed position to one of said disks at the face of the web opposite to the face engaged with said disk to apply a retarding force on one face of said web while an opposing driving force is applied by said disk to the opposite face of said web.

9. The machine of claim 1 or 8 wherein said retarding fingers comprise elongated, convex surfaces engaged with the faces of said web.

10. A method for processing a selected web of material comprising providing two side-by-side sets of spaced apart driven disks rotatable respectively in opposite directions about two spaced apart parallel axes, the axes being sufficiently close that peripheral margins of the disks of one set run between the peripheral margins of the disks of the other set in a mated relationship, the peripheries of the sets of disks mutually defining a series of web driving regions spaced apart in a direction parallel with said axes, with successive web driving regions offset from one another, open channels between said disks providing, with said driving regions, a width-wise continuous, non-linear cross-section corridor through which said web passes, leading a web lengthwise into said corridor in a manner to cause said driving regions to impart crosswise tension in said web, pulling said web about the edges of said rotating disks, said tension enabling said disks to apply forward driving force to said web and providing retarding means in the form of two sets of retarding fingers, one set disposed on each side of the web with fingers interposed in the spaces between respective disks, whereby the fingers in one set are laterally offset with respect to fingers in the other set, said fingers being closely disposed to said driving regions, and located and constructed to apply retarding forces on said web in the region of said corridor over a short distance relative to the radius of said disks, said retarding forces opposing said driving forces to produce immediate, continual longitudinal shortening of said web.

11. The method of claim 10 including applying tension to the web in the machine direction following said retarding means to substantially pull out lengthwise compaction produced by said retarding means, thereby to provide a softened web of length corresponding substantially to the original length of the web.

12. The method of claim 10 wherein said forward driving force applied by said disks is sufficient to solely drive said web through said process.

13. The method of claim 10 wherein said selected web is wrapping material for buildings comprised of a hot calendered mass of spun bonded fibers, the fibers in the interior of said web being relatively unbonded for defining a relatively soft insulating mass.

14. The method of claim 10, 11 or 12 performed on said web for the purpose of loosening fiber-to-fiber bonds and rendering the web relatively more soft or pliable, including the step, after said shortening, of applying tension in the web to remove at least some of said shortening.

15. The method of claim 10, 11 or 12 wherein said selected web has hard external surfaces.

16. The method of claim 10, 11 or 12 wherein said selected web has substantial tensile strength in the direction of both its width and length, and the web is driven forward only by the effect of crosswise tension engaging the web about the edges of said rotatably driven disks.

* * * * *

UNITED STATES PATENT AND TRADEMARK OFFICE

CERTIFICATE OF CORRECTION

PATENT NO. : 4,921,643

DATED : May 1, 1990

INVENTOR(S) : Richard R. Walton et al.

It is certified that error appears in the above-identified patent and that said Letters Patent is hereby corrected as shown below:

Col. 2, line 51; change "16. 18" to --16, 18--;

Col. 5, line 17; change "rotatinG" should be --rotating--.

Signed and Sealed this

Thirty-first Day of March, 1992

*Attest:*

HARRY F. MANBECK, JR.

*Attesting Officer*

*Commissioner of Patents and Trademarks*